United States Patent [19]

Palmaer

[11] 4,293,960

[45] Oct. 13, 1981

[54] HEADGEAR

[76] Inventor: Tore G. Palmaer, S-330, 30 Gnosjö, Sweden

[21] Appl. No.: 41,540

[22] Filed: May 22, 1979

[30] Foreign Application Priority Data

May 30, 1978 [SE] Sweden ..... 7806254

[51] Int. Cl.[3] ..... A42B 3/02

[52] U.S. Cl. ..... 2/416; 2/420

[58] Field of Search ..... 2/416, 418, 417, 420

[56] References Cited

U.S. PATENT DOCUMENTS

| | | | |
|---|---|---|---|
| 3,127,615 | 4/1964 | Aileo | 2/416 |
| 3,430,260 | 3/1969 | Johnson et al. | 2/416 |
| 3,510,879 | 5/1970 | Webb | 2/416 |
| 3,555,560 | 1/1971 | Rascke | 2/416 |
| 3,909,846 | 10/1975 | Zahn | 2/416 |

FOREIGN PATENT DOCUMENTS

| | | | |
|---|---|---|---|
| 218753 | 5/1961 | Austria | 2/420 |
| 998695 | 7/1965 | United Kingdom | 2/420 |
| 502629 | 4/1976 | U.S.S.R. | 2/416 |

*Primary Examiner*—Peter P. Nerbun

[57] ABSTRACT

A helmet comprises a helmet lining; a helmet shell and an impact absorbing crash element for interposition between the helmet lining and a helmet shell, the helmet lining comprising a curved first part adapted to cover the nape of the neck and a curved second part adapted to cover the forehead, the first and second part being interconnected and arranged to be detachably secured to the crash element. The helmet lining is an example of a number of uses of an item of headgear to which accessories can be attached.

7 Claims, 7 Drawing Figures

HEADGEAR

The present invention relates to headgear for the attachment of various accessories such as earmuffs, earphone, helmet shell, etc.

The invention will be described with reference to its use as a helmet lining but it will be appreciated that there are many other applications for it.

As is known the lining of a helmet is intended to position and secure the helmet on the head of the wearer and also to damp the transmission of any shocks from the helmet shell to the head of the wearer. The shell of the helmet is therefore always the same size, whereas the heads for which it is intended may vary in size. The greatest deviation in size is in the length of the skull and the vertical arc measurement from ear to ear across the skull. These are generally parallel to the curved surfaces of the skull between forehead and neck, which are seldom small between the side sections of the skull. It is a fact that the skull is strongest at the front and rear portions (forehead and nape of neck) and these portions should rather take up any shocks, whereas the intermediate portions, i.e. temples and fontanelle should be protected from pressure.

According to the present invention there is provided headgear comprising a curved first part adapted to cover the nape of the neck and a curved second part adapted to cover the forehead, said first and second parts being interconnected and at least one of them being provided with means for the attachment of an accessory such as an ear muff, earphone or helment shell.

The invention also provides in combination; a helment lining; and an impact absorbing crash element for interposition between the helmet lining and a helmet shell; in which the helmet lining comprises a curved first part adapted to cover the nape of the neck and a curved second part adapted to cover the forehead, the first and second part being interconnected and arranged to be detachably secured to the crash element.

According to a suitable embodiment of the invention said parts are arranged to be urged towards each other by means of a tension strip or by means of spring force. The forehead and neck parts may suitably be connected with each other by means of side pieces which are adjustable in length and arranged to be in contact with the circumference of the skull.

In a preferred embodiment of the invention the headgear is used as a helment lining together with a crash element and comprises a bowl-shaped first part covering the nape of the neck and a bowl-shaped second part covering the forehead, said first part and said second part being at least partially elastically joined to each other and arranged to be detachably secured in the crash element. The crash element may in this case constitute an integral part of the inside of the helmet shell or it may be a separate part detachably secured between shell and crash element.

The invention will be further described by way of example with reference to some embodiments shown in the accompanying drawings, in which.

Figure 1:
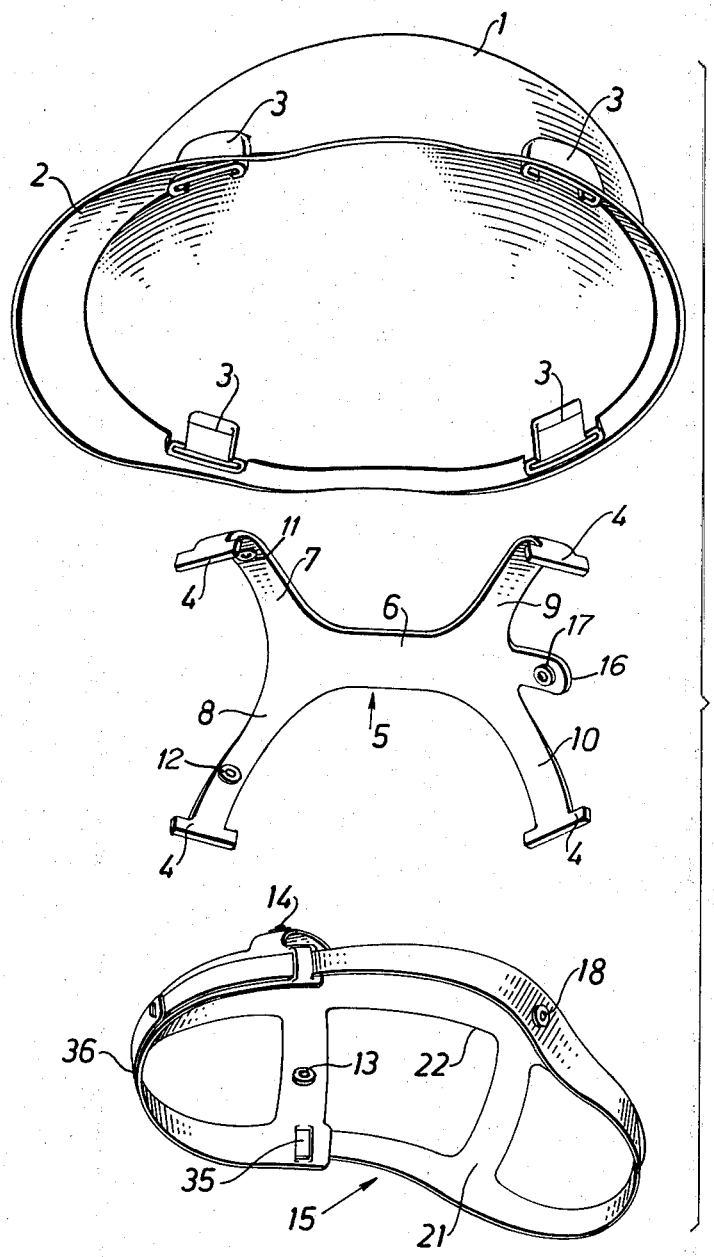
FIG. 1 is an exploded view of headgear according to the invention, used as a helmet lining.

FIG. 1 shows a helmet shell 1 with a front brim 2 and four attachment members 3 intended to receive, for instance, the holder members 4 of a crash element 5, which are intended to be inserted into these attachment means. The crash element 5 consists of a central piece 6 and yoke-like members 7, 8, 9, 10 protruding from each end of the central piece 6. The front yoke members 7, 8 are each provided with an attachment element 11, 12 to secure them to corresponding elements 13, 14 in a helmet lining generally designated 15. The crash element 5 is also provided with a tongue 16 protruding between the yoke members 9, 10 and having an attachment 17 to secure it to a corresponding attachment 18 on the lining 15.

Figure 2:
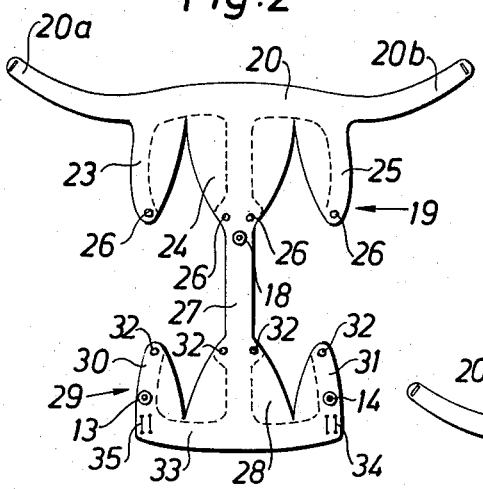
FIG. 2 is a view of the blank from which the lining in accordance with FIG. 1 has been manufactured.

The construction of the helmet lining 15 can be seen more clearly in FIG. 2. Here the blank for the helmet lining is shown flattened out. The lining 15 comprises a first part 19 covering the nape of the neck and consisting of a transverse strip intended to form the side pieces 21, 22 in the assembled lining, as well as three protruding flaps 23, 24, 25, the two outer flaps 23, 25 being arranged to be secured to the middle flap by means of snap-fasteners 26 or the like to form a bowl-shaped configuration of the part 19. The middle flap 24 continues into a connection piece 27 which at the opposite ends continues into a middle flap 28 in a second bowl-shaped part 29 covering the forehead which, besides the middle flap 28, also comprises flaps 30, 31 arranged one on each side of the middle flap and facing the connection piece 27, and also a transverse strip 23 common to all the flaps. The part covering the forehead should also be dome or bowl-shaped, this being achieved by securing the flap ends 30 and 31 to the middle flap 28 by means of suitable snap fasteners 32. The ends of the transverse strip 33 are provided with slits 34, 35 so that the ends **20*a* and 20*b* of the strip 20 can be passed therethrough, after which these ends 20*a* and 20*b* are preferably joined together by means of an elastically yielding intermediate piece 36**.

When, therefore, the blank shown in FIG. 2 has been assembled in the manner described above, the lining 15 shown in FIG. 1 is obtained.

As will be explained in more detail below, instead of the flaps 23, 24, 25 and 30, 28, 31 shown with unbroken lines, narrower straps may be used—but having the same function—as can be seen from the broken lines in FIGS. 2 and 4. Furthermore, the connection piece 27 may also be in two parts so that it is adjustable in length, or it may have an elastic section.

Figure 3:
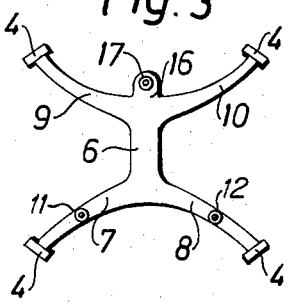
FIG. 3 is a view of a crash element also included in the headgear shown in FIG. 1.

FIG. 3 shows the crash element of FIG. 1 flattened out with the central piece 6, holders 4 and yoke members 7, 8, 9 and 10.

Figure 4:
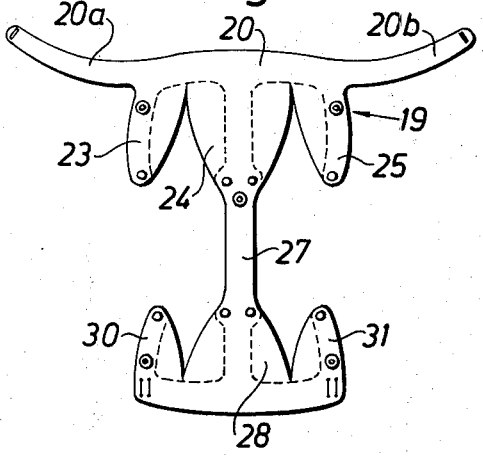
FIGS. 4 and 5 are views of an alternative form of the lining blank and crash element pertaining thereto.
Figure 5:
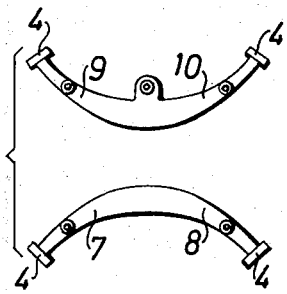

As can be seen from FIGS. 4 and 5, the connection piece 27 of the lining may also serve directly as the central piece of the crash element, in which case the yoke members 7, 8, 9 and 10 are secured directly to the lining. Alternatively the normal central piece of the crash element may service as the connection piece 27.

The headgear described above provides excellent positioning of the helmet on the head of the wearer as well as providing the desired dampening effect with respect to shocks transmitted from the shell of the helmet to the skull of the wearer. Furthermore, the shell and the crash element are adjusted to each other and to the protection desired. The crash element and inner lining can also be adjusted to each other and to the pressure or shock being taken up by the strongest sections of the skull, i.e. the forehead and nape of the neck, while the temples and fontanelle with their blood vessels and nerve ends are not subjected to any noticeable pressure during normal use.

Figure 6:
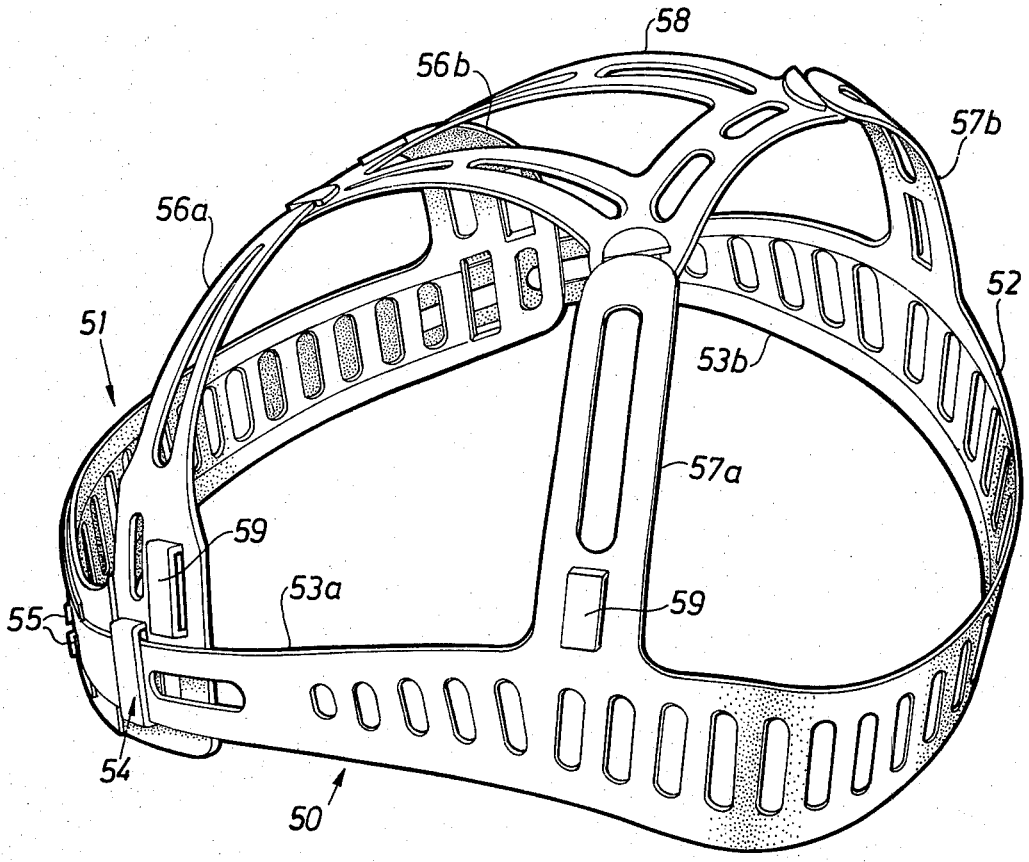
FIGS. 6 and 7 are perspective views of a further embodiment of the invention.
Figure 7:
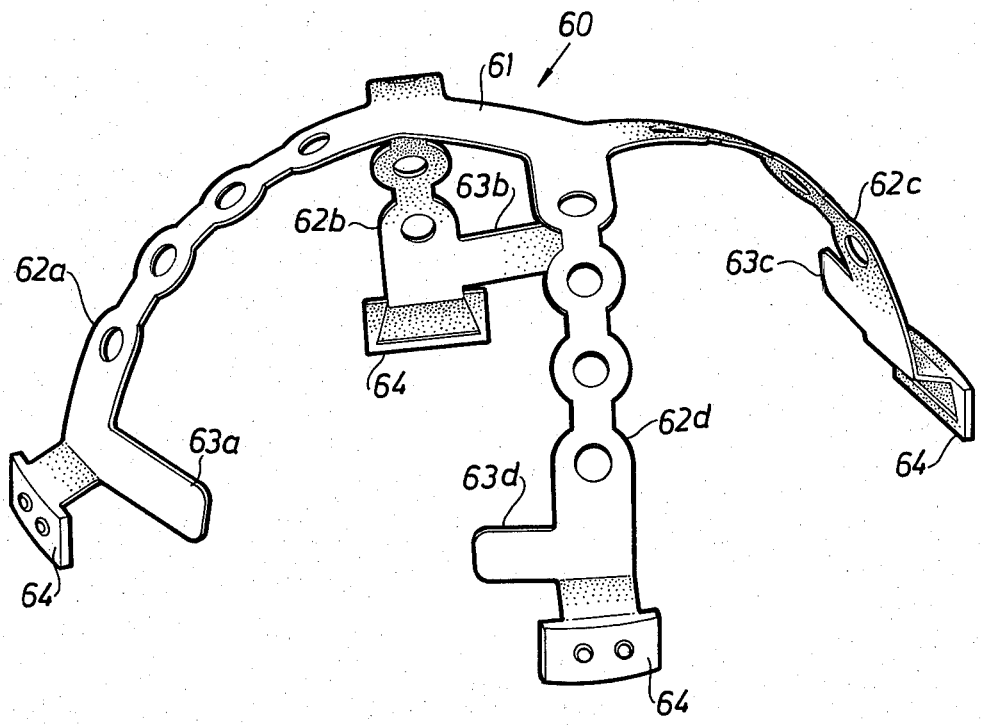

FIG. 6 shows a further embodiment of the invention for use as a helmet lining, to be used in association with the crash element 60 of FIG. 7 and a helmet shell similar to that of FIG. 1. The helmet lining 50 comprises a first part 51 corresponding to the first part 19 of FIGS. 1 to 3 and comprising a horizontal strip to fit the forehead and a second part 52 corresponding to the second part 29 of FIGS. 1 to 3 and domed to fit the nape of the neck. The second part 52 comprises a horizontal strip, the free ends of which provide two forwardly extending flaps 53*a*, 53*b* which pass through slots provided by upstanding rectangular-c-shaped members such as 54 on the part 51. The position of the part 51 relative to the part 52 is adjustable by engagement of studs such as 55 in appropriate ones of a row of holes in the flaps 53*a*, 53*b*. The front part 51 and rear part 52 are provided with respective pairs of flaps 56*a*, 56*b* and 57*a*, 57*b* which curve over the top of the skull and are interconnected by an open rectangular part 58.

The crash element 60 of FIG. 7 is domed to conform approximately with the skull and comprises a central web part 61 and four arms 62*a–d* arranged in two yoke-like configurations as in the embodiment of FIGS. 1 to 3. Towards the free ends of the arms 62*a–d* are respective sideways extending tongues 63*a*–63*d* which serve to attach the crash element to the helmet lining of FIG. 6 by insertion of the tongues through slots provided by respective upstanding portions 59 of the flaps 56*a*, *b* and 57*a*, *b*. At the free ends of the arms 62*a–d* are elements 64 which correspond to the holder members 4 of the embodiment of FIGS. 1 to 3.

The helmet lining is primarily designed to be conveniently adjusted to varying sizes and shapes of skull as well as to be adapted for other requirements. The forehead section, for instance, may be made permeable to air for summer use or impermeable for winter use, winds, cold, etc. The design shown thus provides a forehead section and a neck section which are joined to each other in such a way that a certain resilience is obtained between them, i.e. there is a certain spring tension between them. This spring or elastomeric effect can be achieved, for example, by elastic strips or other suitable spring means.

As has already been pointed out above, the lining may also to a certain extent be made an integral part of the crash element, particularly if the crash element itself is an integral part of the shell of the helmet, consisting of foam plastic sections already cast into the shell, for instance.

The side pieces of the lining, and even other suitable parts, may of course be covered quite easily with shock-absorbent foam plastic or the like.

However, the invention is not limited to its application as a lining for helmets, but may also be used as a normal headpiece, serving to attach earphones, earmuffs, etc.

I claim:

1. Protective headgear for mounting within a helmet, comprising an impact-absorbing crash element having means thereon for releasable attachment to cooperable means carried by a helmet shell whereby said crash element is mountable to extend within the helmet shell in spaced relation thereto, said crash element also having means thereon for adjustably and releasably attaching same in spaced superposed relation to a helmet lining; and a helmet lining which comprises a first curved section adapted to cover the nape of the neck and a second curved section adapted to cover the forehead, said first curved section including a first transverse strip arranged to form side pieces in the lining when assembled and three flaps arranged in sequence along the length of said transverse strip, the two outer ones of the flaps being arranged to be secured to the middle one of the flaps to form a domed configuration conforming generally to the skull; the helmet lining further comprises a connection piece into which the middle flap continues; and said second curved section including a second transverse strip with three flaps arranged along the length of the strip, the middle one of the flaps being connected with the connection piece, there being attachment element to secure the two other flaps of the second part to its middle flap.

2. Headgear according to claim 1, wherein the second transverse strip is provided with means defining slots for accomodating the free ends of the first transverse strip.

3. Headgear according to claim 2 and including an elastically yielding interconnecting piece interconnecting said free ends of the first transverse strip.

4. Headgear according to claim 2, wherein the free ends of said first strip are securable in a number of positions relative to said second strip.

5. Headgear according to claim 1, wherein the crash element comprises front and rear pairs of members each pair being arranged in a yoke-like configuration, and adapted to be detachably secured to the helmet lining.

6. Headgear according to claim 5 wherein one of the helmet lining and the crash element is provided with horizontally extending tongues engageable in slots defined in the other of the helmet lining and the crash element for releasably and adjustably connecting said helmet lining and crash element.

7. Headgear according to claim 5, wherein the members are arranged to extend down round the sides of the head and have free ends provided with means for releasably securing the crash element to a helmet shell.

* * * * *